US005625907A

United States Patent [19]

Svoboda

[11] Patent Number: 5,625,907

[45] Date of Patent: May 6, 1997

[54] WATER SAVING DEVICE FOR WATER CLOSET

[76] Inventor: Peter Svoboda, 1980 Prospector Dr., Leadville, Colo. 80461

[21] Appl. No.: 440,098

[22] Filed: May 12, 1995

[51] Int. Cl.[6] ..... E03D 1/00

[52] U.S. Cl. ..... 4/353; 4/415; 4/225.1

[58] Field of Search ..... 4/353, 415

[56] References Cited

U.S. PATENT DOCUMENTS

| | | | |
|---|---|---|---|
| 2,183,677 | 12/1939 | Heath | 4/353 |
| 2,807,024 | 9/1957 | Kapp | 4/353 |
| 3,086,546 | 4/1963 | Brown | 137/436 |
| 4,134,164 | 1/1979 | Sanmartin Rial | 4/353 |
| 4,145,775 | 3/1979 | Butler | 4/415 |
| 4,429,423 | 2/1984 | Syrenne | 4/415 X |
| 4,449,259 | 5/1984 | Davies et al. | 4/415 |
| 4,764,996 | 8/1988 | Pino | 4/415 |
| 4,980,932 | 1/1991 | Stemples | 4/415 |
| 5,134,729 | 8/1992 | Shaw | 4/415 |
| 5,287,565 | 2/1994 | Auman et al. | 4/415 |

*Primary Examiner*—Robert M. Fetsuga

*Attorney, Agent, or Firm*—Ramon L. Pizarro; Edwin H. Crabtree

[57] ABSTRACT

A water saving device for use with a fill tube on a water closet having a reservoir tank and a bowl, the fill tube being in fluid communication with the bowl. The water saving device saves water by reducing the amount of water that is delivered to the bowl of the water closet. The water saving device has a hollow body with a fluid passage. The hollow body is attachable to the fill tube of the water closet. The fluid passage has an entrance end for receiving water from the fill tube, an exit end and for permitting water to exit the hollow body and a flow constriction along the fluid passage reducing the cross-sectional area of the fluid passage. The hollow body also has at least one side aperture between the entrance end and the flow constriction, the aperture extends from the hollow body to the outer surface of the hollow body so that water entering the fluid entrance end from the fill tube is forced to exit out of both the fluid exit end and the side aperture.

2 Claims, 3 Drawing Sheets

WATER SAVING DEVICE FOR WATER CLOSET

BACKGROUND OF THE INVENTION (a) Field of the Invention

This invention generally relates to a water waste prevention device for a water closet having a reservoir tank and a bowl, and more particularly, but not by way of limitation, to an attachment for a fill tube in a water closet for preventing the waste of water by increasing the efficiency of the water closet's use of water, and more particularly to a device for enhancing the efficiency of a water closet by diverting excess water flow into the water closet's reservoir tank instead of into the bowl.

(b) Discussion of the Prior Art

One of the most common designs for water closets includes a bowl which serves as a receptacle for receiving waste and is in fluid communication with a sewer line. Common designs for water closets also include a water reservoir tank, the reservoir tank holds the water that is to be used for carrying waste from the bowl and into the sewer line, as well as for refilling the bowl.

The bowl is normally in fluid communication with the sewer line by means of a curved exit path commonly referred to as a trap. The trap is simply an "S" shaped duct having a high point that serves to limit the amount of water to be held in the bowl and to provide a siphon for drawing the waste out of the bowl. In operation, to flush waste out of the bowl, water from the reservoir tank is released into the bowl. This raises the level of the water in the bowl, which will exceed the level of the high point of the trap. When the level of the water in the bowl exceeds the level of the high point of the trap, the water in the bowl flows over the high point of the trap, towards the sewer line. The flow over the high point of the trap also initiates a siphoning effect that helps draw out the waste within the bowl, and thus helps completely flush out the waste and nearly completely empty the water within the bowl.

Once the water from the reservoir has been used to flush the waste the bowl, the reservoir tank must then be refilled. The tank is refilled with water from an external water source, such as a water line from the building's potable water system. Inside the reservoir tank a fill control mechanism which includes a valve attached to a float is typically used to control the refilling of the reservoir tank with the water from the external source. As is well known, the float rises as the water level in the tank rises. As the float rises, the float continuously closes the valve, so that the valve is completely closed by the float when a desired level of water is achieved in the tank.

During the flushing cycle, once the waste has been flushed from the bowl, the bowl must be gradually refilled with water from external water source, which must be added to the reservoir tank. It is important to gradually refill the bowl because if the bowl is filled rapidly the water in the bowl can momentarily exceed the high point of the trap, which will in turn induce a siphoning effect in the trap. A siphoning effect in the trap will once again draw out and flush the water from the bowl.

The design of the reservoir tank's fill mechanism provides safeguards against overfilling the reservoir tank. To prevent the overflow of the reservoir tank, an overflow tube which is in fluid communication with the bowl is provided within the reservoir tank. The overflow tube extends vertically from the bottom of the reservoir tank and has an opening at a height that establishes the maximum fill level of the reservoir tank. The overflow tube is in fluid communication with the bowl, and thus allows excess water that may be delivered into the reservoir tank to overflow into the overflow tube and into the bowl.

To fill the bowl after a flush, a fill tube is branched from the valve and extended to the opening of the overflow tube. This allows water from the external source to be diverted into the overflow tube instead of remaining in the reservoir tank. Once the water from the fill tube enters the overflow tube it then flows into the bowl. Thus, the valve continuously feeds water into the bowl while the reservoir tank is being refilled.

Thus, the typical fill system for a water closet advantageously uses one valve to control both the filling of the reservoir tank and the bowl. The simplicity of this design has made this a very popular arrangement in many, if not most, household installations. However, the fact that one valve controls the filling of both the reservoir tank and the bowl has serious drawbacks in that it results in the waste of thousands of gallons of treated potable water throughout the country every year. The waste stems from the fact that it takes much more water to fill the reservoir tank than to fill the bowl. Therefore, the valve remains open, filling the reservoir tank, for much longer than is required to fill the bowl through the fill tube and the overflow tube. The result is that water continues to enters the overflow tube from the fill tube and is then delivered to the bowl after the level of water in the bowl has reached the level of the high point of the trap. The excess water that enters the bowl is simply allowed to flow over the high point of the trap where it is discarded into the sewer line.

Because of the seriousness of the resulting waste of potable water, there have been many attempts to correct this problem. Since many of the water closets now in use have the wasteful system in place, many of the attempts at solving this problem are retrofits or modifications to the existing systems. These remedial or retrofit systems have the advantage that they do not require radical modifications to, or waste of, existing installations. For example, U.S. Pat. No. 2,807,024 to Kapp teaches that by placing a close ended (blind) tube in parallel to the overflow tube and by leading the fill tube into the parallel tube one may use the parallel tube as a ballast or reservoir for controlling the amount of water that eventually overflows from the parallel tube into the overflow tube. This device is disadvantaged, however, in that it can be noisy. The Kapp device allows water to drip out of a weep hole and into the reservoir tank. This dripping can be annoying and undesirable. Also, the parallel tube will always contain an amount of stagnant water, which can serve as an incubator for organic matter which would eventually accelerate the staining of the bowl with organic matter. Moreover, the Kapp device uses many relatively large parts which can result in increased manufacturing and inventorying costs.

In yet another example, U.S. Pat. No. 3,086,546 to Brown a combined water saving and silencing device is taught. The Brown device uses both a plurality of tubes to carry the water into the reservoir tank quietly and a threaded adjustable flow restrictor. The flow restrictor screws into the fill tube fluid passage and reduces the flow path to the fill tube. This arrangement is disadvantaged however in that it requires many parts and can thus be cumbersome to install and maintain. Also, the threaded flow restriction requires that the installer thread and manually adjust the flow past the restriction. This type of installation is disadvantaged in that it is labor intensive and can produce nonuniform results due to installer judgement error.

U.S. Pat. No. 4,145,775 to Butler presents yet another attempt at solving the problems associated with the waste of water during the filling of the reservoir tank. The Butler invention teaches the installation of a flow restrictor in the fill tube. The flow restrictor comprises of a two piece valve that permits adjustment of the flow path by rotating each piece relative to each other. While this device can be effective in restricting the flow through the fill tube it also suffers from limitations. The device's two piece construction is vulnerable to leaks, which can be especially noisy. Also, the valve requires manual adjustment by the installer, and thus is susceptible to installer error or negligence in setting the flow path at the optimal setting.

In yet another example of water saving devices, U.S. Pat. No. 4,449,259 to Davies et al., a one piece metering device which receives and accumulates water from the fill tube is taught. The metering device has a small orifice that permits accumulated water to seep out and into the overflow tube. This device offers advantages in that it is a one piece device, it does restrict the amount of water entering the overflow tube, it does not affect the function of the existing installation and does not require modifications to the existing installation. However, the Davies device also suffers from several limitations in that excess water just overflows the device and drips into the reservoir tank creating noise. Also, the Daives device is relatively large, and thus requires more raw material in fabrication. Also, in certain applications the device may experience difficulties supplying enough water to fill the bowl while maintaining a small enough flow through its flow orifice to effect any significant water savings.

Still other approaches at the problem of wasting water include U.S. Pat. No. 4,764,996 to Pino, which discloses the use of a graduated pinch clamp to restrict the path through the fill tube; U.S. Pat. No. 4,980,932 to Stempies, which teaches the use of a double ballcock flow splitting valve to divide the flow from the fill tube; and U.S. Pat. No. 5,134,729 to Shaw, which teaches the use of a metering device and a flow diverting elbow, and which requires the replacement of almost all of the internal devices of the reservoir tank and adds many parts to achieve a working apparatus.

Another example of devices for reducing the waste of water while refilling the reservoir tank is U.S. Pat. No. 5,287,565 to Auman et al. The Auman patent teaches the use of a small plastic insert with a generally square cross section and a generally rectangular body that serves as a manifold for several exit outlet tubes. The Auman device receives water from the fill tube in its rectangular body which evenly distributes the water over several exit tubes. The user directs the flow of a desired number of exit tubes into the overflow tube and allows the balance of the tubes to spill into the overflow tank. The rectangular body of the Auman invention offers a flow path that presents an expanded cavity with a cross-section that is larger than the cross-section of the flow path (wetted area) of the fill tube. This expanded cavity allows even dispersion into exit tubes through openings that are of the same size. The Auman device is designed to reduce the pressure from the fill line by providing an expanded cavity that acts as a plenum that evenly distributes the water over the ports that lead to the exit tubes. The user determines which of the exit tubes are to empty into the overflow tube and which tubes spill into the overflow tank. This arrangement is disadvantaged in that it is noisy because the many tubes that empty into the reservoir tank spill directly on to the water within the tank, and thus can produce splashing noises. Moreover, the header or plenum design tends to slow the exiting streams to the point where it becomes less likely that the streams will be fully and evenly distributed when entering the bowl. This lack of velocity and dispersion on entering the bowl can lead malfunctions and to uneven rinsing of the bowl with each flush. Still further, the lack of velocity and dispersion can lead to quicker staining of the bowl by minerals deposited by the water.

There remains, therefore, a need for a simple device for reducing the water wastage during the filling of the reservoir tank. Importantly, there remains a need for a simple device that uses few parts and that can be used with existing water closet installations, regardless of the manufacturer.

Moreover, there remains a need for a water closet water saving device that is reliable, easy to install and that does not require special skills to achieve optimal or desired results. Also, there remains a need for a simple, effective, quiet apparatus for reducing the waste of water during the filling of the reservoir tank of a water closet.

SUMMARY OF OBJECTS AND FEATURES

It has been discovered that a water saving device that can be installed on the fill tube of a water closet having a reservoir tank; the device includes a hollow body with an entrance that can attach to the fill tube, an exit for allowing water to enter the overflow tube, a flow constriction just before the exit and at least one side aperture between the constriction and the exit so that water from the flow tube that passes through the exit can be directed at delivering water into the overflow tube and water flowing out of the aperture can be directed to flow at a wall or side of the reservoir tank.

The exit and apertures should each have a smaller fluid carrying capacity than the entrance to the hollow body. The differences in the sizes of the exits in comparison to the entrance allows the device to force a redistribution of the flows. Moreover, the differences in the sizes of the exits produces a significant acceleration of the exiting flows, and more importantly, produces an acceleration of the flow exiting through the side aperture. It is important to accelerate the flow exiting through the side aperture because by accelerating the flows one can ensure that a stream of water earmarked for the reservoir tank will strike the wall of the reservoir tank before flowing into the water stored within the reservoir tank. This ensures quiet operation of the invention by diverting water into the reservoir tank while causing little or no splashing.

The design of the exits can benefit from including a nozzle shaped flow path in the side aperture. A nozzle shape can enhance the acceleration of the exiting stream. The entrance of the device can be of any shape that permits attachment to the fill tube of the reservoir tank fill mechanism.

Thus it can be appreciated that it is an object of the instant invention to provide a quiet water saving device for a water closet.

It is also an object of the instant invention to provide a water saving device that diverts water away from the overflow tube and into reservoir tank in a quiet manner.

It is yet another object to provide a simple water saving device that is easy to manufacture, economical to store and inventory by taking up very little space, and uses no moving parts.

It is yet another object of the instant invention to provide a simple water saving device that is easy to install and requires no adjustments. This provides a device that is not susceptible to installer error or installer judgment.

It is another object of this invention to provide a water saving device that can be used with the reservoir tank filling mechanism of almost any manufacturer.

Moreover, those skilled in the art will readily appreciate that another object of the instant invention is to provide a simple water saving device that can be installed with little or no modifications to a user's existing reservoir tank mechanism.

Thus the described water saving device for a water closet offers advantages in installation, simplicity, manufacturability, operation and economy that could not be achieved by the prior art. These and other advantages and objects of the present invention will become apparent to those skilled in the art from the following detailed description and accompanying drawings, showing the contemplated novel construction, combinations and elements as herein described, and more particularly defined by the appended claims, it being understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DESCRIPTION OF THE PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
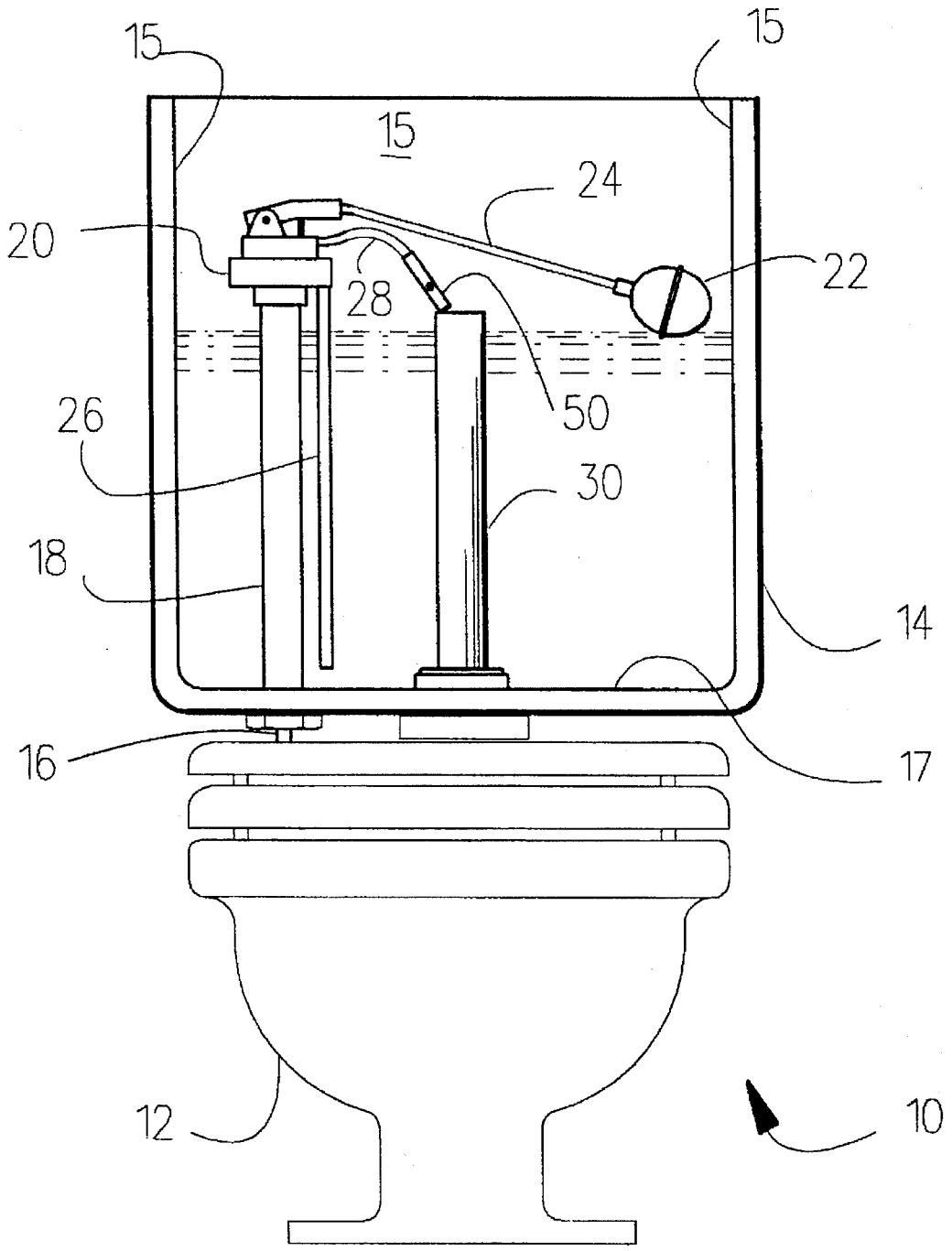
FIG. 1 is an elevational view of a water closet installation using the instant invention, the front wall of the reservoir tank and some of internal mechanisms have not been shown for clarity.

In FIG. 1 a conventional water closet installation which is connected to a sewer line (not shown) is shown generally having a reference numeral 10 is shown having a bowl 12 and a reservoir tank 14 having walls 15. The reservoir tank 14 is filled with water from an external water source 16, which enters the reservoir tank through a riser 18 that supports a valve 20. The valve 20 controls the flow of water into the reservoir tank 14. The opening and closing of the valve 20 is controlled by a float 22 which is connected to the valve 20 by means of a valve control rod 24. The position of the float 22 is determined by the level of the water within the reservoir tank 14. When the water level in the reservoir tank 14 drops below a predetermined level, the float 22 drops and moves the valve control rod 24. Movement in the valve control rod 24 actuates the valve 20, opening or closing the valve 20, in order to control the amount of water needed to refill the reservoir tank 14. The method for controlling the valve 20 by means of a float 22 together with linkages is well known, and the float 22 and valve control rod 24 arrangement described herein is to be understood as being exemplary only and not a limitation. Other arrangements, such as those having a float that surrounds the riser 18, as well as other known methods for controlling the actuation of the valve 20 are also contemplated as being useable with this invention.

When the valve 20 is opened, the valve 20 allows water to flow into a water inlet tube 26, which empties into the reservoir tank 14. The water inlet tube 26 is typically placed so that it empties near the bottom of the reservoir tank 14, so that water delivered into the reservoir tank 14 does not make splashing or dripping noises while filling the reservoir tank 14.

When the valve 20 is opened it also allows water to flow into a fill tube 28, which empties into an overflow tube 30 having an entrance 31. The overflow tube 30 is in fluid communication with the bowl 12, so that once water from the fill tube 28 has entered the overflow tube 30 it can then flow into the bowl 12. The water that enters the bowl 12 is used to fill the bowl 12 or is discarded into the sewer line if the bowl 12 is full (at a designed maximum fill level).

Figure 2:
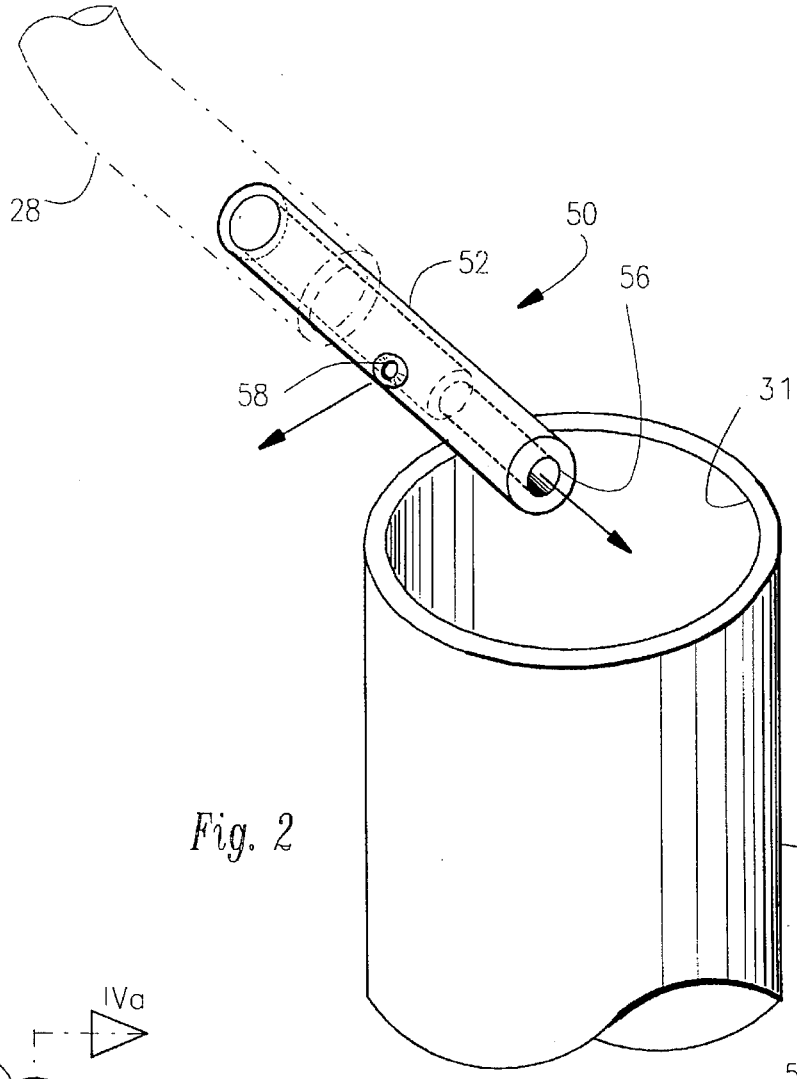
FIG. 2 is a perspective view of the device installed over an overflow tube.

Turning now to FIG. 2, which shows a water saving device according to the present invention, referenced generally with the numeral 50. The water saver device 50 is shown on FIG. 2 and is also shown on FIG. 1 as installed on the fill tube 28. As can be seen in FIG. 2, the water saver 50 can be placed at the entrance 31 of the overflow tube 30. However, the water saver may also be installed anywhere along the length of the fill tube 28 by simply cutting the fill tube 28 at the position where water saver 50 is to be installed and installing the water saver 50 between the two sections of fill tube 28.

FIG. 2 shows that the water saver 50 accepts the flow from the fill tube 28 and divides this flow into streams which have been depicted in FIG. 2 by arrows originating from the water saver 50. In a preferred embodiment the water saver 50 divides the flow into two streams, one stream is directed into the entrance 31 of the overflow tube 30 and the other stream is directed towards the walls 15 inside of the reservoir tank 14. For quiet operation, it is important that flows that have been diverted to the inside of the reservoir tank 14 be projected so that they impinge against the walls 15 of the reservoir tank 14 before joining the water that is already in the reservoir tank 14.

Figure 3:
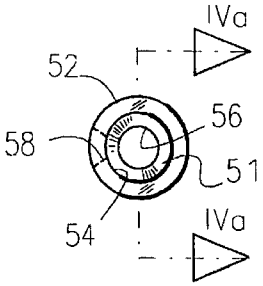
FIG. 3 is an end view of a preferred embodiment, looking into the entrance of the hollow body of the device.
Figure 4:
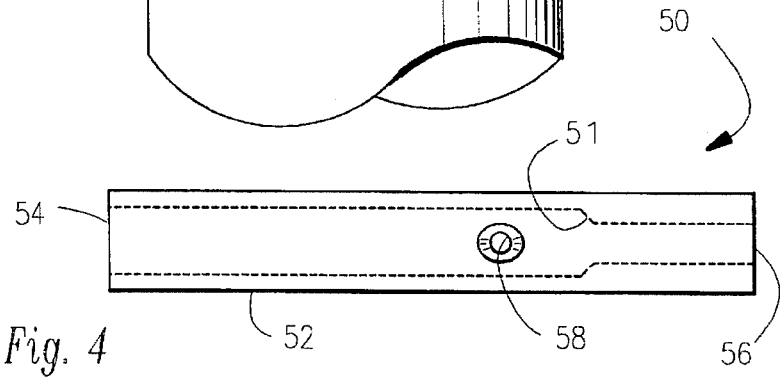
FIG. 4 is a side view of a preferred embodiment of the device.
Figure 4A:
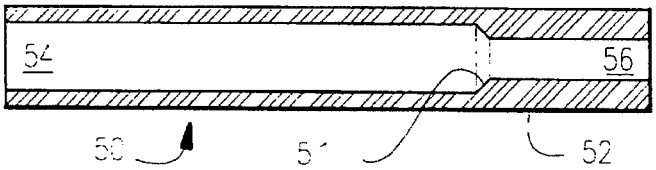
FIG. 4A is a side view of a section taken along line IVa—IVa on FIG. 3 showing the interior of a preferred embodiment of the device.

FIG. 3, FIG. 4 and FIG. 4A illustrate that the water saver device 50 includes a hollow body 52 that includes an entrance 54 at one end an exit 56 at another end and at least one side exit, or aperture 58 on the side of the hollow body 52. It is important to note that the term "exit" as used herein is intended to mean a flow path or aperture for permitting the flow of water.

As can be seen from FIG. 2 and FIG. 4A, the general arrangement of the hollow body 52 of the water saver 50 presents a flow path that includes a flow restriction 51, which in a preferred embodiment is formed by the reduction in cross-sectional area of the end exit 56. The flow restriction 51 is placed in the preferred embodiment at about three quarters of the length of the hollow body 52 and serves as a constricting means to reduce the cross-sectional area of the flow path. The flow restriction 51 forces a redistribution of the flow and accelerates the flow exiting from the fill tube 28 through the end exit 56 and enhances the acceleration of flows exiting through the side exit 58 of the invention 50. Acceleration of the flow enhances the operation of the instant invention by ensuring that flows directed towards the interior of the reservoir tank 14 have enough momentum to reach the walls 15 of the reservoir tank 14, and that flows directed towards the overflow tube 30 have enough momentum to ensure proper distribution and operation of the entire system as these flows reach the bowl 12.

As is shown on FIG. 3, the exit 56 at an end of the hollow body 52 has a smaller cross-sectional area than the entrance 54 of the hollow body 52. As explained earlier, the reduction in cross sectional area forces a redistribution of a flow of water that enters the entrance 54 of the hollow body 52. Thus the restriction 51 ensures that some of the water that enters the entrance 54 of the hollow body 52 will flow through the exit 56 and the balance will flow through the side aperture 58. In other words, since the entrance 54 has a larger cross-section and, hence, more flow capacity than the end exit 56, the flow that enters the water saver 50 is forced to flow through the end exit 56 and through the side aperture 58. The side aperture 58 also has a cross-sectional area that is smaller than the cross-sectional area of the entrance 54.

As is well known, a reduction in the cross-sectional area of a fluid flow will cause an acceleration and a reduction in the pressure along the flow. As stated earlier, acceleration of the flow is advantageous to the instant invention in that acceleration helps ensure that the flow through the side aperture 58 of the instant invention 50 has enough momentum to reach the walls 15 of the reservoir tank 14. During operation, the side aperture 58 should preferably face the rear or back walls 15 of the reservoir tank 14. This will ensure that the stream of water leaving the side aperture 58 will impinge on the walls 15 of reservoir tank 14, where any noise made by the striking is least likely to be heard, and thus ensure quiet operation of the water saver 50. It should be noted here that the side aperture 58 has been shown facing the front of the reservoir tank 14 solely for clarity, and that, as stated above, the preferred installation is to have the side aperture 58 face the rear of the reservoir tank 14, so that any noise produced by the impinging of water on the walls 15 is further muffled by, say, the walls of any structure next to the reservoir tank 14.

As is shown on FIG. 2, in a preferred embodiment the end having the entrance 54 of the hollow body 52 is designed to fit into the fill tube 28. Thus the water saver 50 can be attached to the fill tube 28 without having to thread the fill tube 28 or use clamps, couplings or the like in order to attach the water saver 50 to the fill tube 28. Similarly, the exit end 56 of the instant invention is preferably designed to fit into the fill tube 28 in order to provide the user the option of installing the water saver 50 in line, or along the fill tube 28.

Turning now to FIG. 4, which shows a side view of the water saver 50 and greater detail of the side aperture 58, and further showing that a preferred embodiment of the water saver 50 includes a side aperture 58 with beveled or chamfered edges which define a nozzle like flow path. The nozzle like flow path enhances the acceleration of the water flow and, hence, the function of the side aperture 58. The chamfered edges of the side aperture 58 can be made using a #3 countersink, which has a conical shape with an included angle of approximately 60 degrees from the axis of the hole for side aperture 58.

Figure 5:
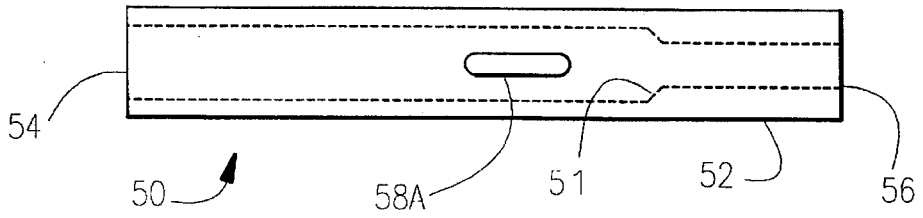
FIG. 5 is a side view of a variation of the invention, having an elongated side exit.

Turning now to FIG. 5, it can be seen that the water saver 50 can include variations such as having a generally slot shaped side exit 58A. One may choose to use a slotted side exit such as the one shown on FIG. 5 in order to allow adjustments in the amount of flow that exits towards the tank 14. In the example shown on FIG. 5 one may control the size of the side exit flow path by simply varying how much of the side exit 58A is covered by the fill tube 28.

Figure 6:
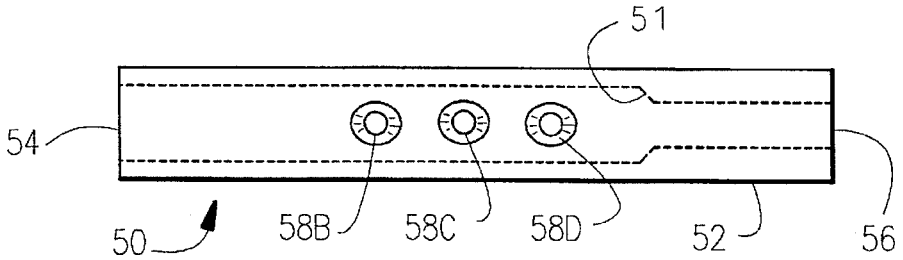
FIG. 6 is a side view of a variation of the invention, showing multiple side exits.

An alternative method for providing variability of the flow into the reservoir tank 14 is to provide several side exits. An example including several side exits, side exits 58B, 58C and 58D is shown on water saver 50 on FIG. 6. One can control the flow of water delivered to the reservoir tank 14 by this example of the invention 50 by simply varying the number of side exits covered by the fill tube 28 on installation.

Figure 7:
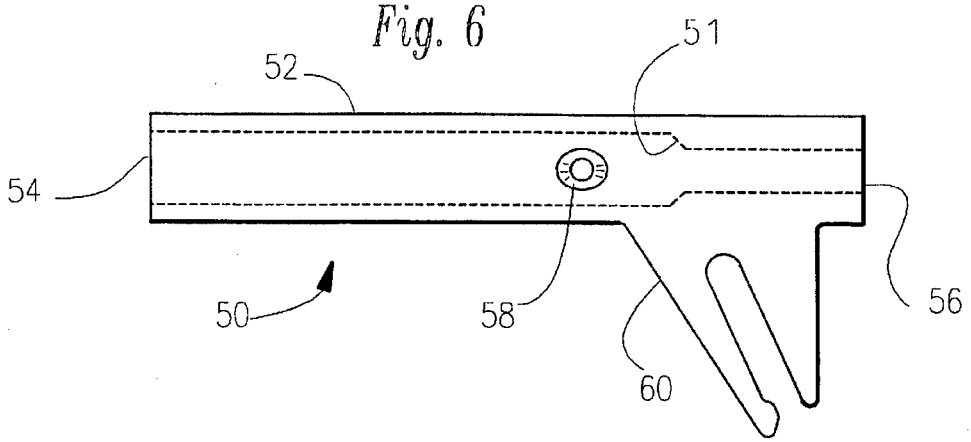
FIG. 7 is a side view of a variation of the invention, showing the invention together with an integral clip.

FIG. 7 shows yet another variation to the instant invention 50. In FIG. 7 a version of the instant invention 50 is shown having an integral clip 60, which is used to position and hold the water saver 50 at the entrance 31 of the overflow tube 30.

Figure 8:
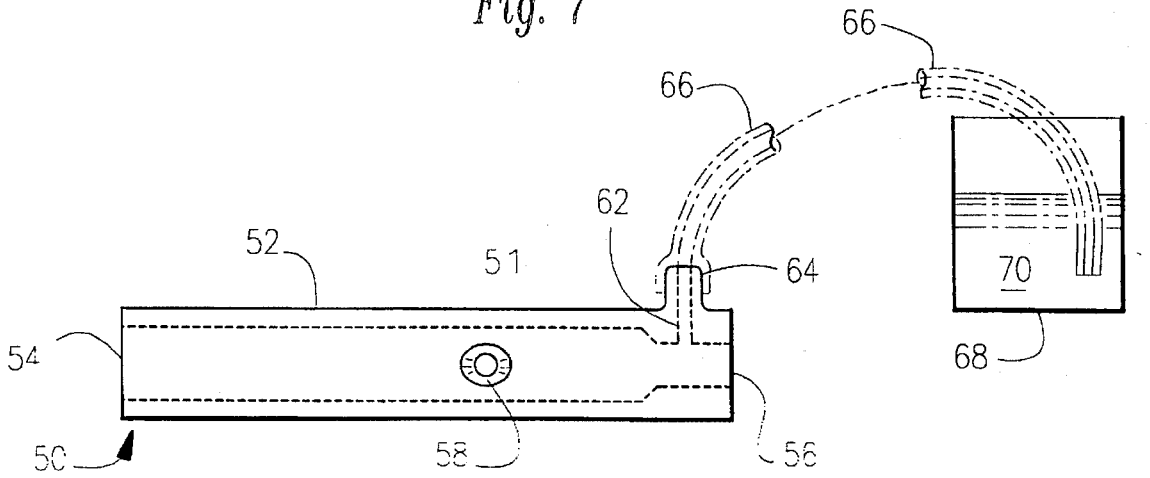
FIG. 8 is a side view of a variation of the invention, showing the invention together with device for introducing fluid additives into the bowl.

Yet another variation to the invention 50 is shown on FIG. 8. This variation takes advantage of the fact that the reduction of the flow path as accomplished by the end exit 56 accelerates the flow while at the same time reducing the pressure along the flow. These parameters allow the inclusion of a venturi type arrangement, which can be used to draw additives into the water used to fill the bowl. Thus in FIG. 8 is shown a water saver 50 further including an orifice 62 that leads from near the end exit 56 and through a nipple 64. The nipple 64 serves as a means for attaching a duct to the hollow body 52 of water saving device 50, and as is well known, the nipple 64 can be substituted by many other means for attaching a duct to the hollow body 52. Mounted on the nipple 64 is a duct 66 for fluid additives. The duct for fluid additives 66 extends from the nipple 64 and into a container 68 which holds fluid additives 70.

By taking advantage of the venturi effect one can use the instant invention to add additives such as colorings, bleaches, scents and antibacterial agents only to the water being added to the bowl, and thus also reduce the amount of additives used during each flush cycle. By reducing the amount of additives used one reduces the amount of chemical waste introduced to the sewer system.

EXAMPLE I

A water saving device according to the principles described herein has been built and tested. The example embodiment was made from a cylindrical nylon body of approximately 1 and ⅛ inches in length and having an outer diameter of approximately 5/16 of an inch. The body was first hollowed out by forming an entrance of ¼ of an inch diameter bore for approximately ¾ of the length of the body along the axis of the body. The end of the bore terminated in a cone of approximately 45 degrees. Concentric to the entrance bore, the remainder of the body was hollowed out using a 3/36 of an inch diameter bore. At approximately mid-length along the body a #3 countersink was used to create a side exit, or aperture, having a conical path that flared out at approximately 60 degrees and having a maximum dimension of approximately 0.115 inches. A device made in accordance with this example has been found to result in a water closet refill system that fills the bowl of the water closet to about ¼ of an inch from the high point of the trap of the water closet and thus saving approximately ½ gallon of water per flush cycle.

EXAMPLE II

A water saving device according to the principles described herein has been built and tested. The example embodiment was made from a cylindrical nylon body of approximately 1 and ⅛ inches in length and having an outer diameter of approximately ¼ of an inch. The body was first hollowed out by forming an entrance of 3/16 of an inch diameter bore for approximately ¾ of the length of the body along the axis of the body. The end of the bore terminated in a cone of approximately 45 degrees. Concentric to the entrance bore, the remainder of the body was hollowed out using a 7/64 of an inch diameter bore. At approximately mid-length along the body a #3 countersink was used to create a side exit, or aperture, having a conical path that flared out at approximately 60 degrees and having a maximum dimension of approximately 0.115 inches. A device made in accordance with this example has been found to result in a water closet refill system that fills the bowl of the water closet to about ¼ of an inch from the high point of the trap of the water closet and thus saving approximately ½ gallon of water per flush cycle.

Thus it can be appreciated that the ratio of the cross-sectional area of bore at the entrance 54 of the hollow body 52 to the cross-sectional area of bore at the exit 56 of the hollow body 52 is from about 1.7 to about 3. Moreover, it can be appreciated that variations and modifications can be made to the present invention without departing from the broad spirit and scope of the invention. Thus it would be within the abilities of those with ordinary skill in the art to modify the above embodiments without departing from the broad principles described herein. The above described embodiments are illustrative of just a few of the numerous variations of arrangements of the disclosed elements used to carry out the disclosed invention. Thus it is seen that the present invention provides a simple device for saving water in a water closet installation by reducing the amount of water wasted during the reservoir tank refilling cycle.

Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A method for reducing the amount of water delivered to a bowl of a water closet having a reservoir tank, the reservoir tank having a plurality of substantially vertical walls and a bottom, the reservoir tank enclosing a valve and an overflow tube, the overflow tube extending in a substantially vertical manner from the bottom of the tank and terminating in an entrance end above the bottom of the tank, the tank further enclosing a fill tube extending from the valve and to the entrance of the overflow tube the bowl being filled by the fill tube in fluid communication with the bowl by means of the overflow tube, the fill tube further including a water flow dividing device having a one piece hollow body adapted for attachment to the fill tube, the hollow body further having a fluid passage therethrough, the fluid passage having an entrance and an exit, the fluid passage further having an entrance end and an exit end, constricting means for reducing the fluid passage, and at least one side aperture, the side aperture being between the entrance end and the constricting means, the flow dividing device further having means for positioning the flow dividing device relative to the overflow tube such that the side aperture is above the bottom and the aperture facing one of the walls of the tank, the method comprising:

attaching the flow dividing device to the fill tube; and engaging the positioning means with the entrance end of the overflow tube, so that water flowing out of the side aperture is directed to flow against at least one of the walls of the reservoir tank before coming to rest in the reservoir tank and water flowing out of the exit end of the flow dividing device is directed to flow towards the overflow tube.

2. A method according to claim 1 wherein said step of attaching the flow dividing device to the fill tube is accomplished by inserting the flow dividing device into the fill tube.

* * * * *